US010689823B2

(12) United States Patent
Rosier

(10) Patent No.: US 10,689,823 B2
(45) **Date of Patent: *Jun. 23, 2020**

(54) ANCHORING ASSEMBLY

(71) Applicant: MUSTHANE, Willems (FR)

(72) Inventor: Reza Rosier, Dottignies (BE)

(73) Assignee: MUSTHANE, Willems (FR)

( * ) Notice: Subject to any disclaimer, the term of this patent is extended or adjusted under 35 U.S.C. 154(b) by 0 days.

This patent is subject to a terminal disclaimer.

(21) Appl. No.: 16/024,942

(22) Filed: Jul. 2, 2018

(65) Prior Publication Data

US 2018/0327992 A1 Nov. 15, 2018

Related U.S. Application Data

(63) Continuation of application No. 14/785,238, filed as application No. PCT/FR2014/050770 on Apr. 1, 2014, now Pat. No. 10,066,357.

(30) Foreign Application Priority Data

Apr. 19, 2013 (FR) ..... 13 53615
Jun. 14, 2013 (FR) ..... 13 55515

(51) Int. Cl.
*E02D 5/80* (2006.01)

(52) U.S. Cl.
CPC ..... *E02D 5/80* (2013.01); *E02D 5/803* (2013.01)

(58) Field of Classification Search
CPC ..... Y10T 24/3918; Y10T 24/3916; Y10T 24/3703; F16G 11/103; E02D 5/803
See application file for complete search history.

(56) References Cited

U.S. PATENT DOCUMENTS 1,426,945 A * 8/1922 Anderson ..... F16G 11/14 24/130
2,892,518 A * 6/1959 Fiske ..... E02D 5/803 52/163

(Continued)

FOREIGN PATENT DOCUMENTS

EP 0018074 A1 10/1980
EP 0313936 A1 5/1989

(Continued)

OTHER PUBLICATIONS (http://www.djembedirect.com/item/power_grip_clam_cleat_rope_puller, 2005).*

(Continued)

*Primary Examiner* — Brian E Glessner
*Assistant Examiner* — Daniel J Kenny
(74) *Attorney, Agent, or Firm* — MH2 Technology Law Group, LLP

(57) ABSTRACT

The invention relates to an anchoring assembly for fastening an element to the ground, the element including an orifice. The invention is characterized by the fact that anchoring assembly comprises:

an anchoring part;

a flexible line having a first end that is fastened to the anchoring part, the flexible line being designed to pass through the orifice; and a blocking device including an opening, the flexible line extending through the opening, and blocking means for blocking sliding of the flexible line in the opening, the blocking device being suitable for taking up a first position in which the flexible line can slide in the opening in such a manner as to adjust the distance between the blocking device and the anchoring part, and a second position in which the flexible line is (Continued)

blocked in the blocking device in such a manner as to prevent the blocking device from moving relative to the anchoring part.

22 Claims, 11 Drawing Sheets

(56) References Cited

U.S. PATENT DOCUMENTS

| | | | | |
|---|---|---|---|---|
| 2,973,065 | A * | 2/1961 | Cordes | E02D 5/803 52/163 |
| 4,096,673 | A | 6/1978 | Deike | |
| 4,361,938 | A | 12/1982 | Emery | |
| 4,787,660 | A | 11/1988 | Mrazek | |
| 4,993,870 | A * | 2/1991 | Bridgewater | E02B 3/126 405/15 |
| 5,322,386 | A | 6/1994 | Trangsrud | |
| 5,461,833 | A | 10/1995 | Murray | |
| 5,675,872 | A | 10/1997 | Emery | |
| 5,749,180 | A | 5/1998 | Jewett et al. | |
| 5,775,037 | A | 7/1998 | James | |
| 5,987,711 | A | 11/1999 | Parsons | |
| 6,237,289 | B1 | 5/2001 | Jewett et al. | |
| 6,561,833 | B2 * | 5/2003 | Saka | H01R 13/6272 439/352 |
| 7,033,109 | B2 | 4/2006 | Russell et al. | |
| D572,546 | S | 7/2008 | Stahm | |
| 7,513,207 | B2 | 4/2009 | Walker et al. | |
| 7,534,073 | B2 | 5/2009 | Stahm | |
| 7,611,129 | B1 | 11/2009 | Stahm | |
| 7,713,003 | B2 | 5/2010 | Agg | |
| 7,789,594 | B2 * | 9/2010 | Stahm | E02D 17/20 405/302.4 |
| 7,862,259 | B2 | 1/2011 | Carpenter | |
| D633,379 | S | 3/2011 | Chambers et al. | |
| 8,011,860 | B2 | 9/2011 | Stahm | |
| 8,967,918 | B2 * | 3/2015 | Schneider | E02D 5/80 24/530 |
| 9,049,819 | B2 * | 6/2015 | Chang | A01G 1/00 |
| 10,066,357 | B2 | 9/2018 | Rosier | |
| 2009/0041549 | A1 | 2/2009 | Stahm et al. | |
| 2012/0097080 | A1 | 4/2012 | Agg et al. | |

FOREIGN PATENT DOCUMENTS

| | | | |
|---|---|---|---|
| EP | 0863261 | A1 | 9/1998 |
| EP | 0725862 | B1 | 10/1998 |
| EP | 07255863 | B1 | 10/1998 |
| EP | 0884420 | A1 | 12/1998 |
| EP | 1655509 | A2 | 5/2006 |
| EP | 2173950 | A2 | 4/2010 |
| EP | 2580956 | A1 | 4/2013 |
| EP | 2442633 | B1 | 7/2013 |
| EP | 2094914 | B1 | 5/2014 |
| GB | 2283510 | A | 5/1995 |
| WO | 98/12771 | A1 | 5/1995 |
| WO | 97/40234 | A1 | 10/1997 |
| WO | 2009/023108 | A2 | 2/2009 |
| WO | 2009/139753 | A1 | 11/2009 |
| WO | 2013/009364 | A1 | 1/2013 |

OTHER PUBLICATIONS (www.discontramps.com/hose-ramp/p/DH-HR/, 2000).*
Pascar Chitsaka (examiner), Examination Report No. 1 for Australian Patent Appl. No. 2014255600, dated Feb. 10, 2017, pp. 1-3.
https://web.archive.org/web/20120829055522/http://www.clcboats.com/shop/products/boat-gear/sailing-gear-accessories/harken-swivel-cam-cleat-with-bullseye-fairlead-240.html.
www.djembedirect.com/item/power_grip_clam_cleat_rope, 2005.

* cited by examiner

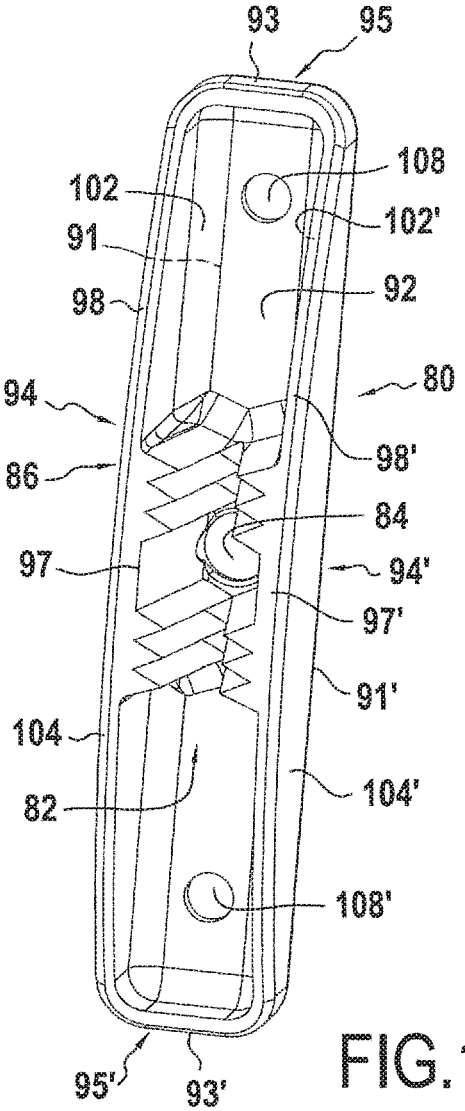
FIG.1A
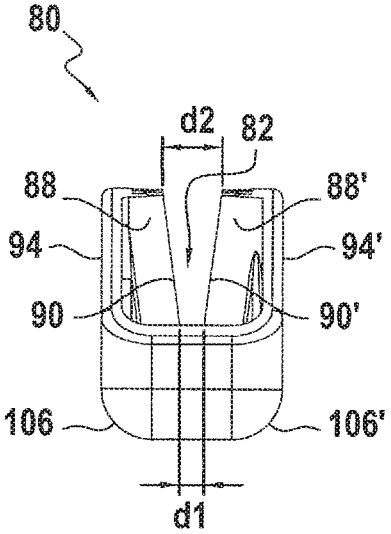
FIG.1B
FIG.1C
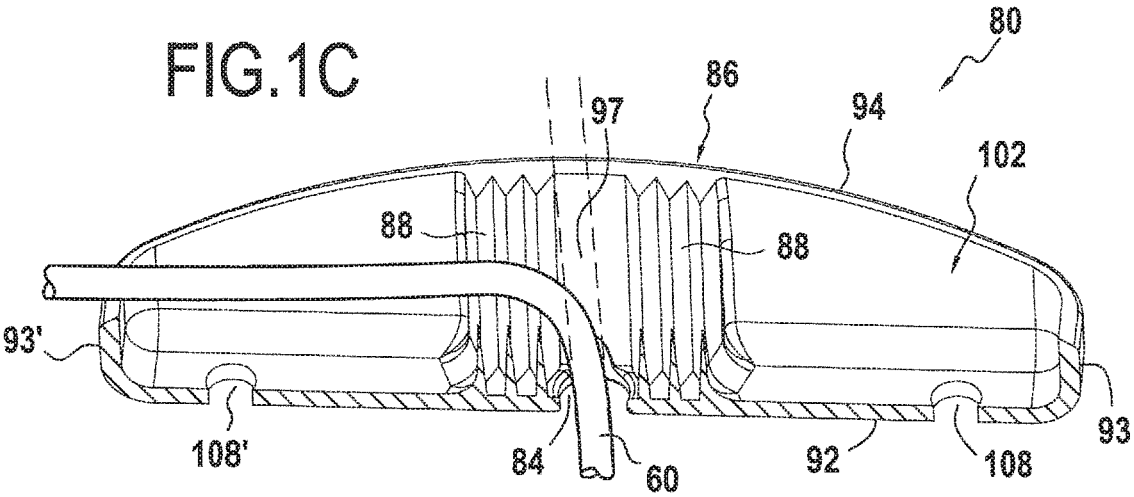

ANCHORING ASSEMBLY

RELATED APPLICATIONS

This application is a continuation of U.S. Ser. No. 14/785,238, filed Oct. 16, 2015, which is a US national phase entry of PCT/FR2014/050770, filed Apr. 1, 2014, and claiming priority to French Application FR1355515 filed Jun. 14, 2013, and French Application FR1353615 filed Apr. 19, 2013, the contents of each of which are herein incorporated by reference.

BACKGROUND OF THE INVENTION

The present invention relates to an anchoring assembly for fastening an element to the ground. In particular, the invention finds an application for fastening an element, such as for example a sheet or a surface covering, to the surface of loose ground, such as sand or earth.

It is known to use rods, such as stakes that are suitable for being made out of metal, that are driven into the ground after being engaged through an orifice formed in the element, or by boring right through the element, in particular when it is a surface covering.

The problem arising from that type of solution lies in the fact that the rods project substantially above the ground when they are used to fasten the element to the ground; they thus constitute a risk of injuring people moving around the element. Furthermore, for a surface covering, when the wind gets into the space between the surface covering and the ground, the rods are likely to be torn from the ground, and thus constitute a danger to people or objects located in the vicinity.

An alternative solution to the use of rods engaged through the element and driven into the ground is proposed by document U.S. Pat. No. 7,789,594, which describes an anchoring assembly comprising an anchor, a cable having a first end that is fastened to the anchor, and a blocking portion. The anchor is engaged through the element to be fastened, and is then pushed into the ground by means of a rod. The second end of the cable, opposite the first end, is arranged at the surface and traction is applied to the second end of the cable thereby blocking the anchor in the ground. The blocking part then serves to hold the element against the ground, secured to the anchor by the cable. Nevertheless, that solution requires a large amount of handling and the use of multiple tools adapted to the various steps of installing the anchoring assembly; in particular, a first tool needs to be used to apply traction to the second end of the cable, and a second tool needs to be used to mount the blocking part on the second end of the cable.

OBJECT AND SUMMARY OF THE INVENTION

An object of the present invention is to make it possible, easily and without requiring the use of many tools, to fasten an element to the ground in stable and strong manner.

This object is achieved by the fact that the invention provides an anchoring assembly for fastening an element to the ground, the element including an orifice, and the anchoring assembly comprising:

- an anchoring part;
- a flexible line having a first end that is fastened to the anchoring part, the flexible line being designed to pass through the orifice; and
- a blocking device including an opening, the flexible line extending through the opening, and blocking means for blocking sliding of the flexible line in the opening, the blocking device being suitable for taking up a first position in which the flexible line can slide in the opening in such a manner as to adjust the distance between the blocking device and the anchoring part, and a second position in which the flexible line is blocked in the blocking device in such a manner as to prevent the blocking device from moving relative to the anchoring part.

The anchoring part and the flexible line thus make it possible to hold the element firmly to the ground.

The use of a flexible line makes it possible to adapt to the various ground configurations to which the element may be fastened; furthermore, it enables the user to apply tension to the line, without risk of being injured. In addition, the end opposite from the end fastened to the anchoring part is left free on the ground, not constituting (e.g. in contrast to the use of a rod or a stake as mentioned above) a danger to the people or vehicles moving in the vicinity of the anchoring assembly.

The blocking device may be moved relative to the anchoring part by adjusting the distance between the blocking device and the anchoring part when the blocking device is in the first position.

In particular, that makes it possible to bring the blocking device against the element. After which, the blocking device is brought into its second position so as to hold the element on the ground, said element being held between the blocking device and the ground.

Moreover, the blocking device also makes it possible, when it is in the second position, to apply tension to the flexible line in order to block the anchoring part in the ground, and thus to hold the element against the ground. The blocking device thus serves as a traction device.

By means of these multiple functions, the number of tools needed for fastening an element to the ground is reduced, without the strength of the fastening being compromised.

Alternatively, the tension applied to the flexible line in order to block the anchoring part in the ground may be exerted by other traction means, which may be separate from the blocking device.

Furthermore, forming an orifice in the element makes it possible to avoid damaging the element or compromising its usage.

In addition, the use of a flexible line and the multiple functions presented by the blocking device confer compactness to the anchoring assembly when it is not in use, thereby making it easier to store and transport.

The invention is presented below in a series of variant embodiments, that may be considered on its own or in combination with one or more of the preceding embodiments.

Advantageously, the blocking device includes a gutter into which the opening opens out.

In this arrangement, the flexible line is engaged through the opening and can slide in the gutter, in such a manner as to adjust the distance between the blocking device and the anchoring part. Furthermore, the portion of the flexible line housed in the gutter of the blocking device does not risk being damaged, or even severed, in particular when the element is fastened to the ground, which would compromise use of the anchoring assembly.

Furthermore, the flexible line is held in the gutter of the blocking device, and does not risk accidentally becoming free.

In addition, by taking hold of the blocking device in the second position, the user can apply significant traction to the flexible line, without risk of being injured on contact with the flexible line.

It should thus be understood that the blocking device may form a handle making it possible to pull on the flexible line, on its own or in combination with a traction device.

Advantageously, the gutter is defined by a base in which the opening is formed, and first and second inside faces, the blocking means comprising at least one rib extending from each of the first and second inside faces.

In advantageous manner, the ribs extend transversely, preferably perpendicularly, relative to the base of the gutter.

In this arrangement, the blocking means make it possible to hold the flexible line in the gutter, in the second position of the blocking device; it should therefore be understood that sliding motion in a direction that is substantially parallel to the bottom wall of the gutter is prevented by the blocking means.

Furthermore, a movement of the flexible line, in such a manner as to extract it from the space formed between the ribs, serves to cause the blocking device to pass from the second to the first position. By way of example, such a movement consists in arranging the flexible line in a direction that is substantially perpendicular relative to the bottom wall of the gutter.

Preferably, the first and second inside faces respectively present first and second top margins.

Advantageously, the ribs are arranged facing each other with each presenting a ridge, the distance between the ridges of the ribs near the base being smaller than the distance between the ridges near the first and second top margins.

In advantageous manner, the space formed between the ribs presents a V-shaped section.

In this arrangement, the flexible line, opening out into the gutter from the opening, may be blocked simply and quickly in the gutter by lowering the flexible line towards the bottom wall of the gutter, the flexible line thus being blocked by the ridges arranged facing each other, the ridges converging towards each other as they get closer to the bottom wall of the gutter. It should therefore be understood that by lowering the flexible line towards the bottom wall of the gutter, the flexible line becomes blocked between the ridges of the ribs, the space between the ridges becoming smaller near the bottom wall of the base.

Conversely, by moving the flexible line away from the bottom wall of the gutter, the flexible line is extracted from the space defined between the two ridges of the ribs, and may thus once again slide in the blocking device, and more particularly through its opening.

The shape of the ribs and the convergence of the ridges thus make it possible to firmly block the flexible line in the gutter, merely by moving the flexible line towards the bottom wall of the gutter.

Preferably, the blocking means comprise a plurality of ribs formed on the first and second inside faces while being arranged on either side of the opening.

Preferably, at least one of the first and second top margins of the first and second inside faces of the blocking device is rounded.

In other words, considered in the plane defined by the corresponding inside face, the top margin presents a rounded portion.

This arrangement makes it easier to grip the blocking device, and also, for example, to apply tension to the flexible line when the blocking device is in the second position.

In advantageous manner, the blocking device has a first plane of symmetry extending perpendicularly relative to the base, between the first and second inside faces.

Preferably, the first and second inside faces of the blocking device are parallel to each other and the blocking device has a second plane of symmetry extending perpendicularly relative to the first and second inside faces and to the base, while passing through the through opening.

The various axes of symmetry of the blocking device enable it to be used easily; furthermore, its ergonomics enables it to be taken hold of easily and firmly.

In addition, the flexible line arranged in the gutter can thus be blocked whatever the side of the gutter towards which it is lowered, thus making it possible to simplify operation of the anchoring assembly, and to limit the risk of accidentally unblocking the flexible line. The term "sides" of the gutter should be understood as comprising both portions of the base, arranged on either side of the opening.

Preferably, the gutter is defined by a base in which the opening is formed, and by first and second sides that extend transversely relative to the base.

In advantageous manner, the first and second sides extend perpendicularly relative to the base.

In this embodiment, it should therefore be understood that the first and second sides present respective first and second inside faces, arranged facing each other towards the inside of the gutter, and first and second outside faces, opposite the respective first and second inside faces.

Preferably, but not necessarily, the first and second sides present respectively, firstly, first and second bottom margins, and, secondly, first and second top margins, each of the first and second sides forming a continuity of material that extends between their respective top and bottom margins. It should be understood that in this embodiment, the top margins of the first and second sides coincide with the top margins of the first and second inside faces.

Advantageously, the blocking device presents a rounded section between one of the first and second bottom margins and the base.

Preferably, the opening is formed in the base, between the first and second bottom margins.

Advantageously, the blocking device includes a rounded section between each of the first and second bottom margins and the base.

In this arrangement, there is no risk of the user being injured when taking hold of the blocking device, nor when applying tension to the flexible line when the blocking device is in the second position.

Furthermore, when the blocking device is placed on the element fastened to the ground, the rounded sections enable the device to be easily tilted, in such a manner that it does not constitute an obstacle that could, for example, damage a vehicle having a wheel that has struck it. In addition, as described above, since the opening is formed in the base, preferably between the first and second bottom margins, the flexible line cannot accidentally become free from the blocking device, in particular when the device is tilted.

Advantageously, the opening is formed in the middle of the gutter.

In this variant, it should therefore be understood that the gutter presents two sides having the same dimensions.

Thus, the force applied by the user on the flexible line is distributed in uniform manner across the blocking device.

In advantageous manner, the blocking device includes a drainage orifice, formed in the bottom wall of the gutter.

Preferably, the blocking device includes two orifices formed in the bottom wall of the gutter, on either side of the opening.

In this arrangement, a liquid, such as for example rain water, which might be flowing in the gutter, can easily be evacuated, in particular so as not to damage the flexible line arranged in the gutter.

In an alternative embodiment, the anchoring assembly further comprises a run-over device configured to be arranged around the blocking device.

In a first variant, the run-over device and the blocking device constitute two separate parts.

In advantageous manner, the run-over device includes a housing dimensioned in such a manner as to receive the blocking device.

In an alternative solution, the blocking device and the run-over device constitute a single part.

When the blocking device is arranged so as to hold the element for fastening to the ground, the presence of the run-over device ensures that the blocking device does not impede the passage of a vehicle, the movement means of the vehicle, such as a wheel, being suitable for running over the blocking device without being damaged.

Preferably, the run-over device presents a convex top surface surrounding the blocking device.

The shape of the top surface makes it possible to avoid the risk of a vehicle getting a flat tire as it travels over the blocking device.

Advantageously, the convex top surface defines a spherical cap.

In advantageous manner, the height of the spherical cap defined by the top surface of the run-over device is equal to, or even greater than, the maximum height of the first and second inside faces of the blocking device.

The term "maximum height" refers to the maximum distance between the bottom margins and the top margins of the first and second inside faces.

In this arrangement, the inside faces defining the gutter of the blocking device do not project from the convex top surface of the run-over device, nor do they even touch the convex top surface, thereby avoiding any risk of damaging the movement means of a vehicle traveling over the blocking device.

Preferably, the run-over device includes a housing having a bottom wall arranged to receive the blocking device.

In this arrangement, the run-over device is held between the ground and the blocking device.

Advantageously, the anchoring part presents a longitudinal direction and comprises a body and a head, which anchoring part is suitable for taking up either an insertion position in which the longitudinal direction is substantially vertical, its head forming a bottom end, or an anchoring position in which the longitudinal direction is substantially horizontal, a force applied to the blocking device when it is in the second position serving to cause the anchoring part to pass from the insertion position to the anchoring position.

Thus, in its insertion position, the anchoring part can easily be inserted in the ground, e.g. via a rod serving to push and to guide the anchoring part under the surface of the ground. In its anchoring position, the anchoring part can be held firmly, so as to fasten the element to the ground in stable manner.

Furthermore, the blocking device, while also being used as traction means, makes it possible to pass easily and quickly from the insertion position to the anchoring position, without requiring additional tools, by means of applying a force to the anchoring part via the flexible line.

The flexible line may be a cable; however, it is preferable for the flexible line to be a cord, of the textile cord type.

In this arrangement, the element may be easily and quickly released from the ground, sectioning of the cord making it possible, for example, to release the blocking device, and, consequently, to withdraw the element from the ground.

Advantageously, the anchoring assembly further comprises withdrawal means comprising a first end fastened to the head of the anchoring part, and a second end configured to be at the surface when the anchoring part is placed in the ground, the withdrawal means being configured in such a manner that traction applied to the withdrawal means serves to pass the anchoring part from the anchoring position to a withdrawal position in which the longitudinal direction is substantially vertical, the head forming a top end.

The withdrawal means thus make it possible, when the user wishes to withdraw the element, e.g. in order to store it or to place it at another site, to withdraw the anchoring part from the ground. Thus, the anchoring assembly may be re-used, and that constitutes an advantage, as much in terms of operating costs as relating to environmental considerations.

In advantageous manner, the second end of the withdrawal means is fastened to the blocking device.

In this arrangement, the user may apply traction to the withdrawal means by using the blocking device, thus benefiting from its above-described ergonomic advantages. In addition, the compactness of the anchoring assembly is not compromised by the presence of the withdrawal means.

Preferably, the withdrawal means comprise a flexible cord.

In addition, the invention also relates to an anchored installation comprising an anchoring assembly of the present invention and an element for fastening to the ground comprising a surface covering presenting a bottom face, arranged towards the ground, and a top face, opposite the bottom face, the blocking device being arranged against the top face of the surface covering when it is in the second position.

In another variant, the blocking device is fastened to the top face of the surface covering; it should thus be understood that the blocking device is permanently mounted on the surface covering, in such a manner that it cannot, amongst other things, be lost.

Thus, the surface covering may be firmly and stably held against the ground, so as to constitute, for example, a surface allowing vehicles to travel thereon. In the second position, the blocking device thus makes it possible to limit the distance between the covering from the ground, in order to prevent, in particular, the wind from getting between the ground covering and the ground.

Preferably, the covering includes a plurality of orifices cooperating with a plurality of anchoring assemblies, so as to improve the stability and strength of the fastening of the element to the ground.

Finally, the invention relates to a method of fastening to the ground an element for fastening to the ground, which method comprises the steps of:

- providing an element provided with an orifice that is placed on the ground;
- providing an anchoring assembly according to the present invention;
- engaging the flexible line in the orifice of the element and in the opening of the blocking device;
- arranging the anchoring part in the insertion position;
- pushing the anchoring part into the ground;

placing the blocking device in the second position;

pulling on the blocking device in such a manner as to cause the anchoring part to pass from the insertion position to the anchoring position;

placing the blocking device in the first position;

bringing the blocking device against the element by sliding it along the flexible line; and placing the blocking device in the second position.

The anchoring assembly of the present invention thus makes it possible to fasten the element to the ground easily and quickly, without requiring devices other than the anchoring part, the flexible line, and the blocking device.

Advantageously, the method also comprises a step in which traction is applied to the withdrawal means, so as to cause the anchoring part to pass from the anchoring position to the withdrawal position, and a step in which the blocking device is placed in the second position and the blocking device is pulled so as to withdraw the anchoring part from the ground.

Alternatively, the anchoring part may be caused to pass from the insertion position to the anchoring position by exerting traction on other traction means.

BRIEF DESCRIPTION OF THE DRAWINGS

Other characteristics and advantages appear more clearly and more completely on reading the following description of a preferred embodiment given by way of non-limiting example, and described with reference to the figures, in which:

FIGS. 1A, 1B, and 1C are diagrams showing an example of the blocking device of the present invention, respectively, in a perspective view from above, in a front view, and in a side section view;

DETAILED DESCRIPTION OF THE INVENTION

Figure 2:
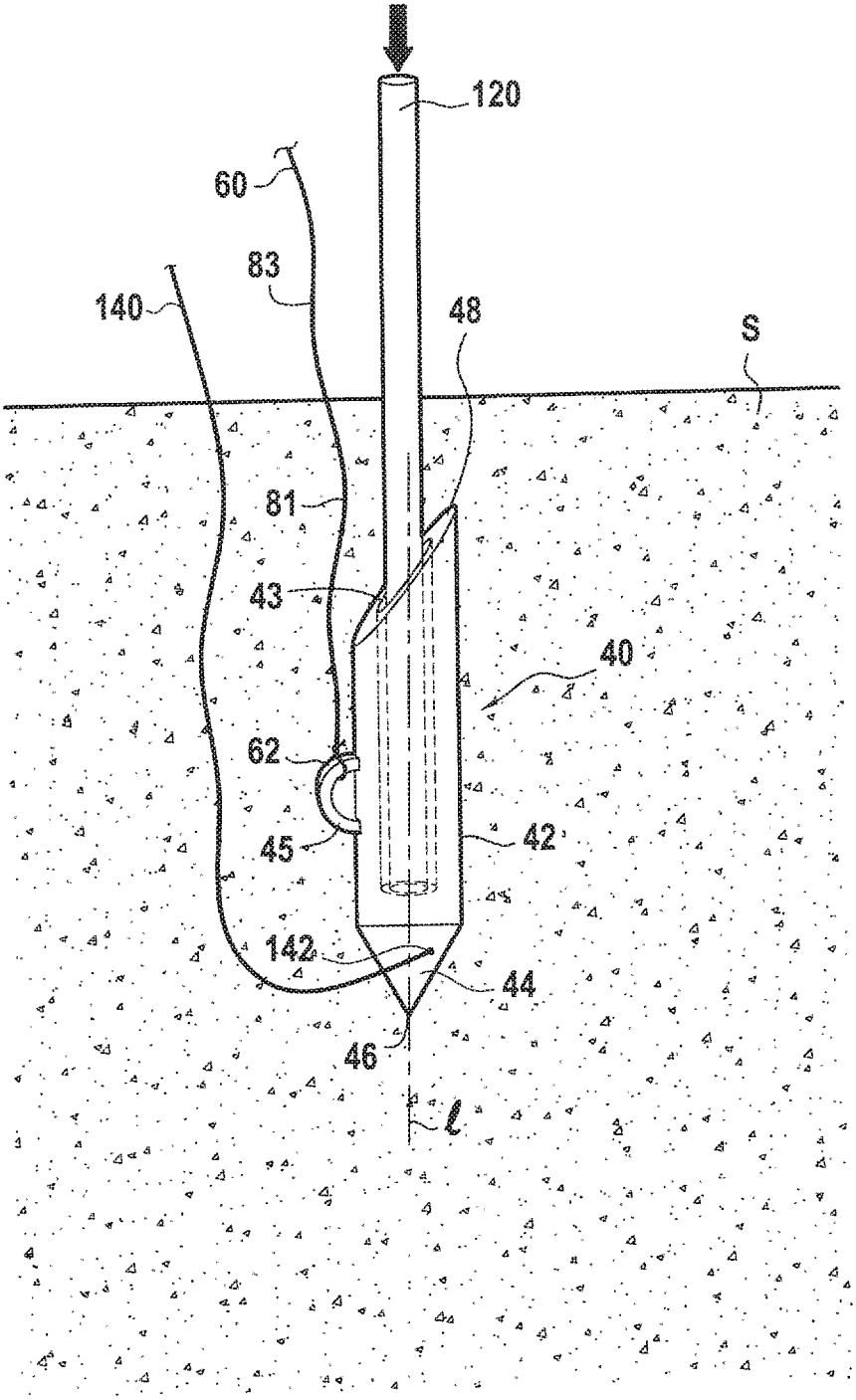
FIG. 2 is a diagram showing an anchoring part of the present invention in an insertion position.

FIGS. 1A, 1B, and 1C are diagrams showing an example of the blocking device 80 in a first example of an anchoring assembly 10 of the present invention.

In this embodiment, shown in particular in FIGS. 1 to 10, the blocking device 80 also constitutes a traction device, in such a manner that the blocking device 80 is referred to as a traction and blocking device.

The traction and blocking device 80 firstly includes a base 92 that may be of a shape that is rectangular, for example and in non-limiting manner. The base 92 includes two side margins 91, 91' arranged parallel to each other, and two end margins 93, 93' that may also be suitable for being arranged parallel to each other, for example and in non-limiting manner.

The traction and blocking device 80 further includes first 94 and second 94' sides extending transversely, preferably perpendicularly, in the same direction, starting from base 92. Moreover, the traction and blocking device 80 also includes two transverse portions 95, 95', extending transversely, preferably perpendicularly, in the same direction as the first and second sides 94, 94', starting from the base 92.

Thus, the sides 94, 94' and the transverse portions 95, 95' extend respectively starting from the side margins 91, 91' and the end margins 93, 93' of the base 92.

The first and second sides 94, 94', the transverse portions 95, 95' and the base 92 define a gutter 82.

As shown in the various figures, the first and second sides 94, 94' include first and second top margins 98, 98' respectively, suitable for being rounded, for example and in non-limiting manner.

The first and second sides 94, 94' include respective first 96 and second 96' bottom margins, respectively opposite the first and second top margins 98, 98', the first and second bottom margins 96, 96' being contiguous with the side margins 91, 91' of the base 92.

Furthermore, the first and second sides 94, 94' present respective first and second inside faces 102', 102', arranged facing each other towards the inside of the gutter 82, and first and second outside faces 104, 104', respectively opposite the first and second inside faces 102, 102'.

The traction and blocking device 80 also includes two rounded sections 106, 106', arranged between the base 92 and the first and second bottom margins 96, 96' respectively, for a purpose that appears more clearly in the description below.

The edges arranged between the base 92 and the transverse portions 95, 95' are also rounded, in such a manner that the base 92 of the traction and blocking device 80 does not include sharp edges.

In addition, the base 92 includes an opening 84 opening out into the gutter 82; more particularly, the opening 84 is arranged between the first and second inside faces 102, 102' of the first and second sides 94, 94'; furthermore, by way of example and in non-limiting manner, the opening 84 is formed in the middle of the gutter 82, i.e., firstly, the distances between the opening 84 and each of the first and second sides 94, 94' are identical, and, secondly, the distances between the opening 84 and each of the transverse portions 95, 95' are also identical.

It may therefore be understood that the traction and blocking device 80 has a first plane of symmetry extending perpendicularly relative to the base 92, between the first and second inside faces 102, 102' of the first and second sides 94, 94'; furthermore, the traction and blocking device 80 also has a second plane of symmetry extending perpendicularly relative to the first and second inside faces 102, 102' of the first and second sides 94, 94' and to the base 92, while passing through the opening 84.

In addition, the traction and blocking device 80 includes drainage means 108, 108', formed in base 92 and also opening out to the gutter 82; these drainage means 108, 108' are configured so as to allow for example a liquid or any other material to drain from the gutter 82.

Furthermore, the traction and blocking device 80 includes blocking means 86; by way of example and in non-limiting manner, the blocking means 86 include ribs 88, 88' formed on the first and second inside faces 102, 102' of the first and second sides 94, 94', each rib 88, 88' presenting a ridge 90, 90'.

By way of example and in non-limiting manner, the blocking means 86 comprise a first series of ribs formed in the inside face 102 on the first side 94, and a second series of ribs formed on the inside face 102' of the second side 94', the ribs being formed opposite one another; it may thus be understood that each pair constituting respective ribs formed on each of the first and second inside faces 102, 102' of the first and second sides 94, 94' defines a space, e.g. a V-shaped space which, as shown in FIG. 1B, converges towards the bottom wall of the gutter 82, in other words, the distance d1 between the ridges 90, 90' of the ribs 88, 88' arranged facing each other, near the base 92, is less than the distance d2 between the ridges of the same ribs, near the first and second top margins 98, 98'.

As shown in particular in FIG. 1A, the first and second series of ribs 88, 88' are formed on either side of the opening 84; the first and second series of ribs 88, 88' thus surround two sliding portions 97, 97' formed on the first and second inside faces 102, 102' of the first and second sides 94, 94' that surround the opening 84.

As shown in FIG. 1C, the opening 84 formed in the base 92 is configured to co-operate with a flexible line 60: the traction and blocking device 80 may thus take up a first position, in which the flexible line 60, shown in dashed lines in FIG. 1C, extends through the opening 84 and is free to slide in the gutter 82, and a second position, in which the flexible line 60, shown in continuous lines, extends through the opening 84, and is blocked in the gutter 82 by the ribs 88, 88' of the blocking means 86. In this example, the flexible line 60 is a cord.

Thus, in the first position, and more particularly when the flexible line 60 extends through the opening 84 in a direction that is substantially perpendicular to the bottom wall of the gutter 82, the above-described sliding portions 97, 97' are configured so as not to oppose sliding of the flexible line 60 in the traction and blocking device 80.

In the second position that is obtained, in particular, when the flexible line 60 is arranged along a direction that is substantially parallel to the bottom wall of the gutter 82, sliding of the flexible line 60 in the gutter 82 along said direction is prevented by the presence of the blocking means 86. More particularly, the presence of the ribs 88, 88' and their above-described shape prevent the flexible line 60 sliding in the traction and blocking device 80.

By moving the flexible line 60 relative to the traction and blocking device 80, and more particularly by moving the portion of the flexible line 60 contained in the gutter 82 from a direction substantially perpendicular relative to the base 92 of the traction and blocking device 80 to a direction that is substantially parallel to the base 92, the flexible line is blocked in the V-shaped space defined between the pairs of ribs 88, 88' formed on the first and second inside faces 102, 102' of the sides 94, 94'. Blocking of the flexible line 60 is particularly facilitated when the flexible line 60 is made of a flexible material, such as a cord.

FIG. 2 is a diagram showing an anchoring part 40 pushed into a ground S.

The anchoring part 40 includes first 46 and second 48 ends, and defines a longitudinal direction e.

The anchoring part 40 further comprises a body 42 and a head 44 that may be pointed or beveled, for example and in non-limiting manner; it also includes, for example and in non-limiting manner, a cylindrical housing 43, formed in the body 42 and opening out towards the second end 48 of the anchoring part 40, and a latch 45 formed on the body 42.

The flexible line 60 has a first end 62 that is fastened to the anchoring part 40, e.g. by means of the latch 45.

The anchoring part 40 may take up an insertion position, shown in FIG. 2, in which the longitudinal direction l is substantially vertical, the head 44 forming a bottom end.

Furthermore, insertion means 120, such as for example a rod, are engaged in the cylindrical housing 43; thus, a force applied vertically and downwards on the insertion means 120 serves to push the anchoring part 40 into the ground S.

When the anchoring part 40 is pushed into the ground S, the flexible line 60 presents a first portion 81 arranged in the ground S and a second portion 83 kept outside the ground S.

Figure 3:
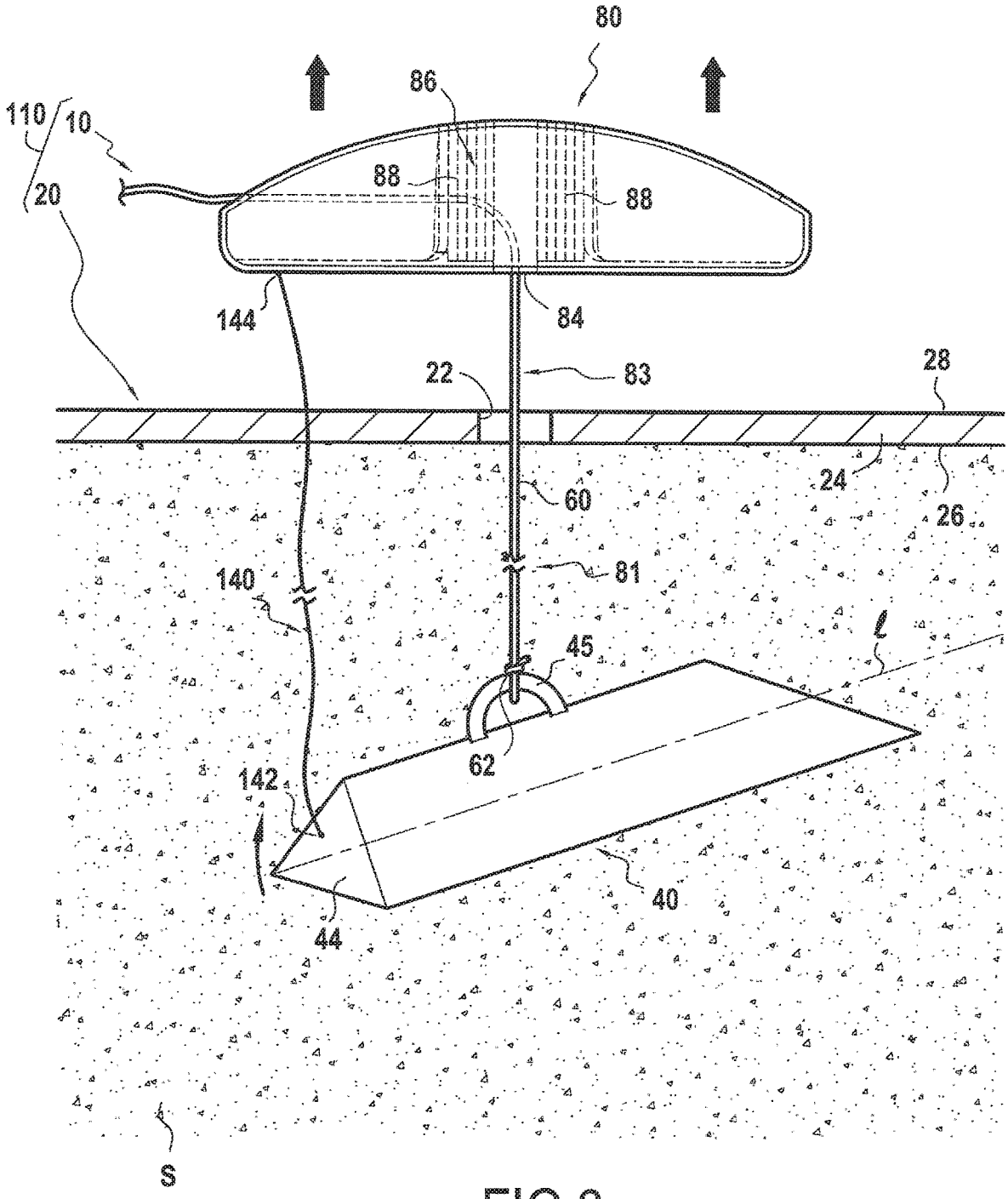
FIG. 3 is a diagram showing a first example of the anchoring assembly of the present invention, the blocking device being in the second position, the anchoring part passing from the insertion position to the anchoring position, the blocking device also being used as a traction device.

FIG. 3 is a diagram showing an anchoring assembly 10, constituted by the traction and blocking device 80, the flexible line 60, and the anchoring part 4; the anchoring assembly 10 also includes withdrawal means 140, having a first end 142 that is fastened to the first end of the anchoring part 40, specifically to the head 44, and having a second end 142 that is fastened to the traction and blocking device 80, for example and in non-limiting manner. The purpose of the withdrawal means 140 appears more clearly on looking at FIGS. 6 and 7.

FIG. 3 also shows an anchored installation 110 that comprises the anchoring assembly 10 and an element 20 for fastening to the ground S.

The element 20 comprises a surface covering 24 presenting a bottom face 26, configured to be directed towards the surface of the ground S, and a top face 28, opposite the bottom face 26; furthermore, the surface covering 24 includes an orifice 22.

The second portion 83 of the flexible line 60 is first of all engaged through the orifice 22 in the surface covering 24, from its bottom face 26, and then through the opening 84 in the traction and blocking device 80, before being arranged in the gutter 82.

The traction and blocking device 80 is placed in the second position, by lowering the flexible line 60 towards the bottom wall of the gutter 82, so that the flexible line 60 cannot slide in the gutter 82.

A force, symbolized by the two vertical arrows of FIG. 3, applied by the user in a substantially vertical upwards direction on the traction and blocking device 80, serves to cause the anchoring part 40 to pivot in the ground S; the pivoting of the anchoring part 40 causes it to pass into an anchoring position, in which the longitudinal direction l is substantially horizontal.

It should be understood that, when the traction and blocking device 80 is in the second position, with the flexible line 60 being prevented from sliding in the gutter 82, the traction and blocking device 80 cannot be moved relative to the anchoring part 40; consequently, by applying a traction force to the traction and blocking device 80, the traction force is also applied to the anchoring part 40, thus serving to cause it to pivot in the ground S.

In addition, the above-described rounded edges of the base 92 and in particular the rounded sections 106, 106', in addition to the rounded shape of the top margins 98, 98' of the first and second sides 94, 94', make it possible for the user to apply significant force without being injured on contact with the traction and blocking device 80.

Figure 4:
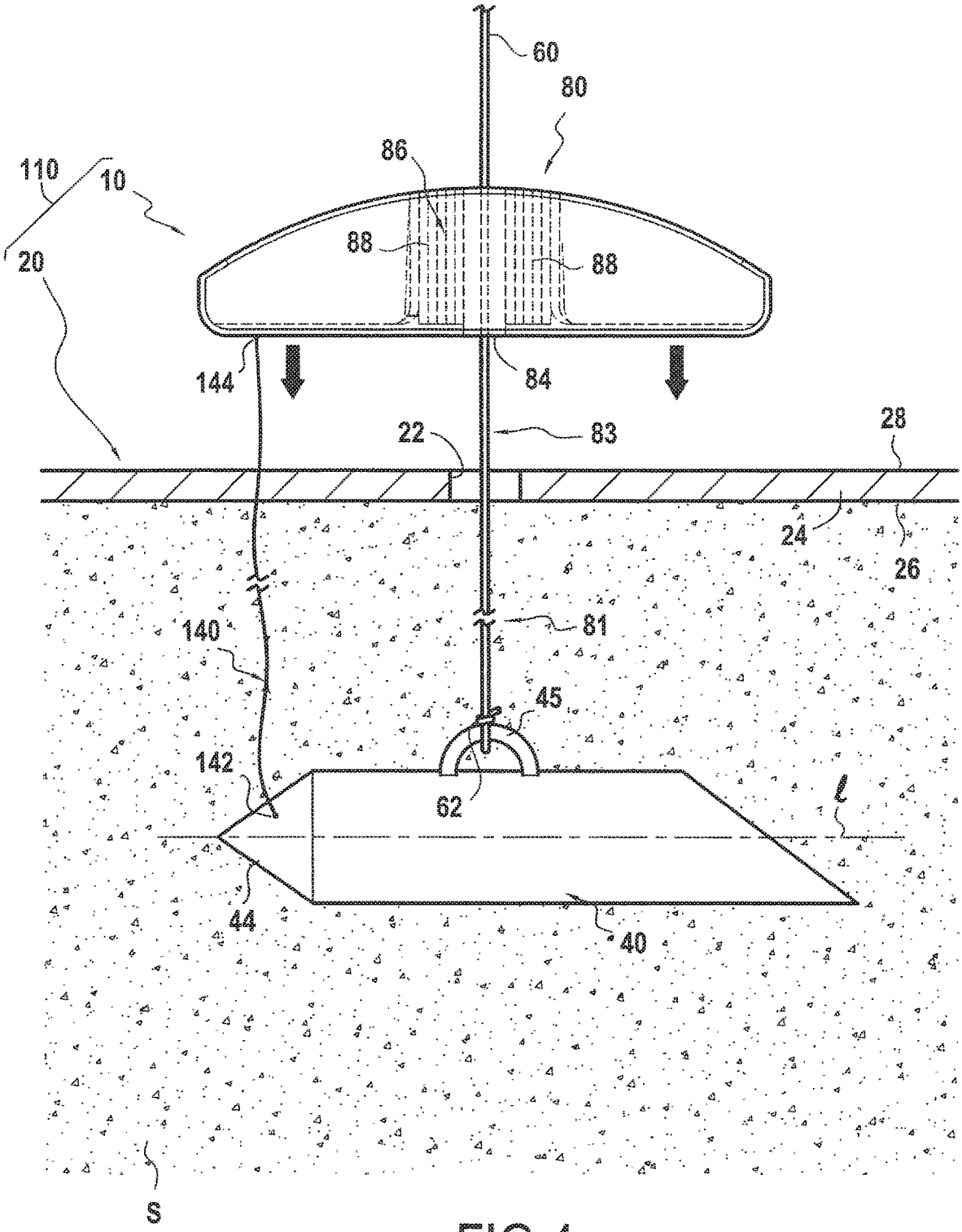
FIG. 4 is a diagram showing the first example of the anchoring assembly of the present invention, the blocking device being in the first position, the anchoring part being in the anchoring position.

FIG. 4 shows the anchoring assembly 10 in which the blocking part 40 is in the anchoring position.

In this position, the anchoring part 40, by means of its shape, and in particular by the shape of its second end 48, opposes it being extracted from the ground S, in such a manner that the anchoring part 40 is firmly held in the ground S.

Consequently, and as shown in FIG. 4, the traction and blocking device is placed in the first position, by moving the flexible line 60 in a direction that is substantially perpendicular relative to the bottom wall of the gutter 82, so as to enable the flexible line 60 to slide in the gutter 82; by sliding the traction and blocking device 80 along the flexible line 60, it is brought against the top face 28 of the surface covering 24. In other words, the element 20 for fastening to the ground S is thus arranged between the surface of the ground and the traction and blocking device 80.

Figure 5:
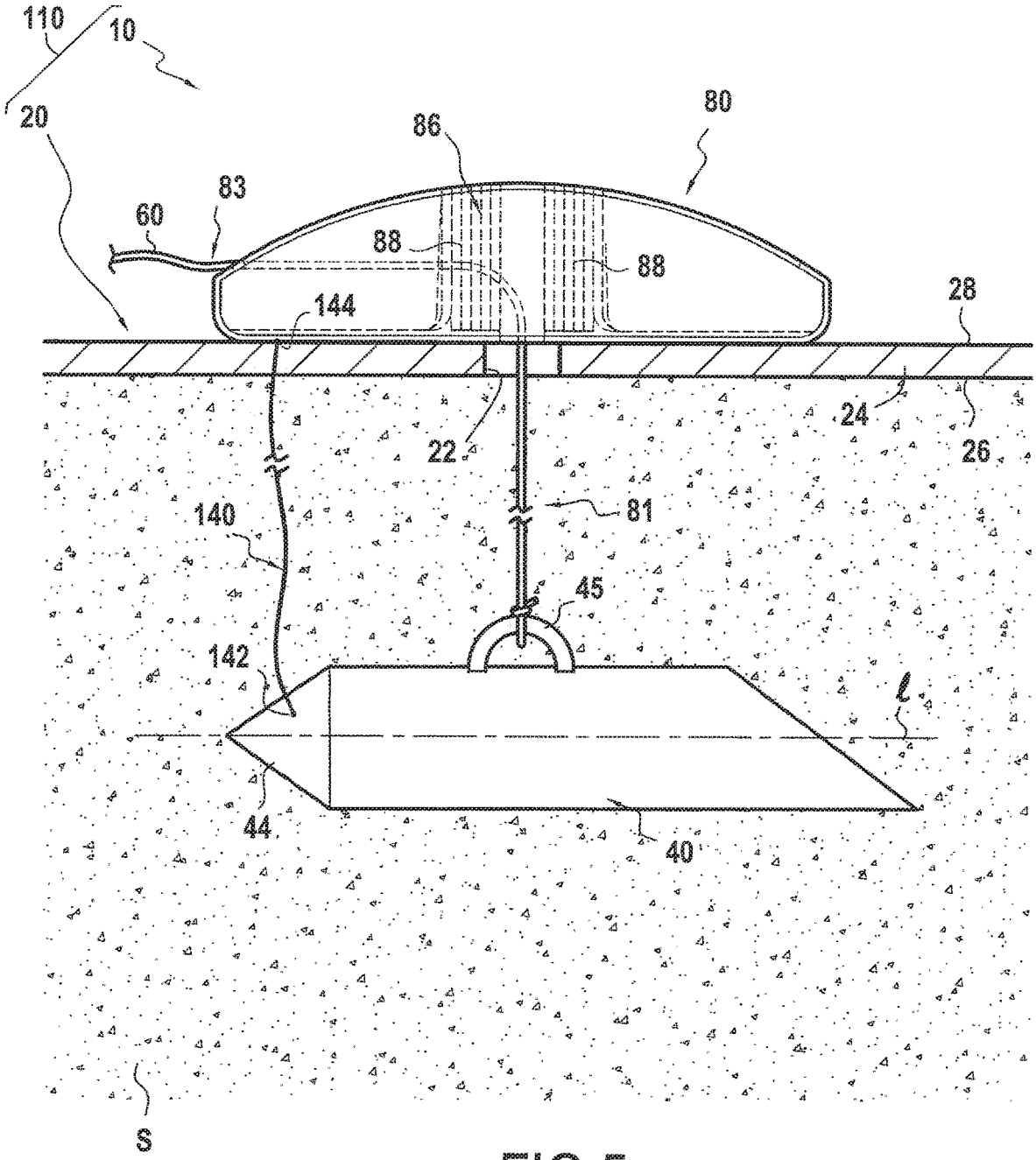
FIG. 5 is a diagram showing the first example of the anchoring assembly of the present invention, the blocking device being in the second position, the anchoring part being in the anchoring position.

FIG. 5 shows the anchored installation 110 in which the element 20 is fastened to the ground S; to do this, after the traction and blocking device 80 has been placed in contact with element 20, it is arranged in the second position in such a manner as to prevent sliding of the flexible line 60 in the gutter 82, and, consequently, in such a manner as to prevent movement of the traction and blocking device 80 relative to the anchoring part 40, in order to hold the element 20 sandwiched between the ground S and the traction and blocking device 80, and more particularly between the ground S and the base of the face 92 opposite the gutter 82.

In this configuration of the anchoring assembly 10, the opening 84 of the traction and blocking device 80 is arranged facing the orifice 22 of the element 20, and the portion 83 of the flexible line 60 arranged outside the ground S is suitable for being brought against the outside face 28 of the covering 24.

Thus, in the event that a person or a vehicle comes into contact with the traction and blocking device 80, the above-described rounded sections 106', 106' cause the traction and blocking device 80 to tilt, so the device does not constitute an obstacle to the progression of the vehicle or person.

Figure 6:
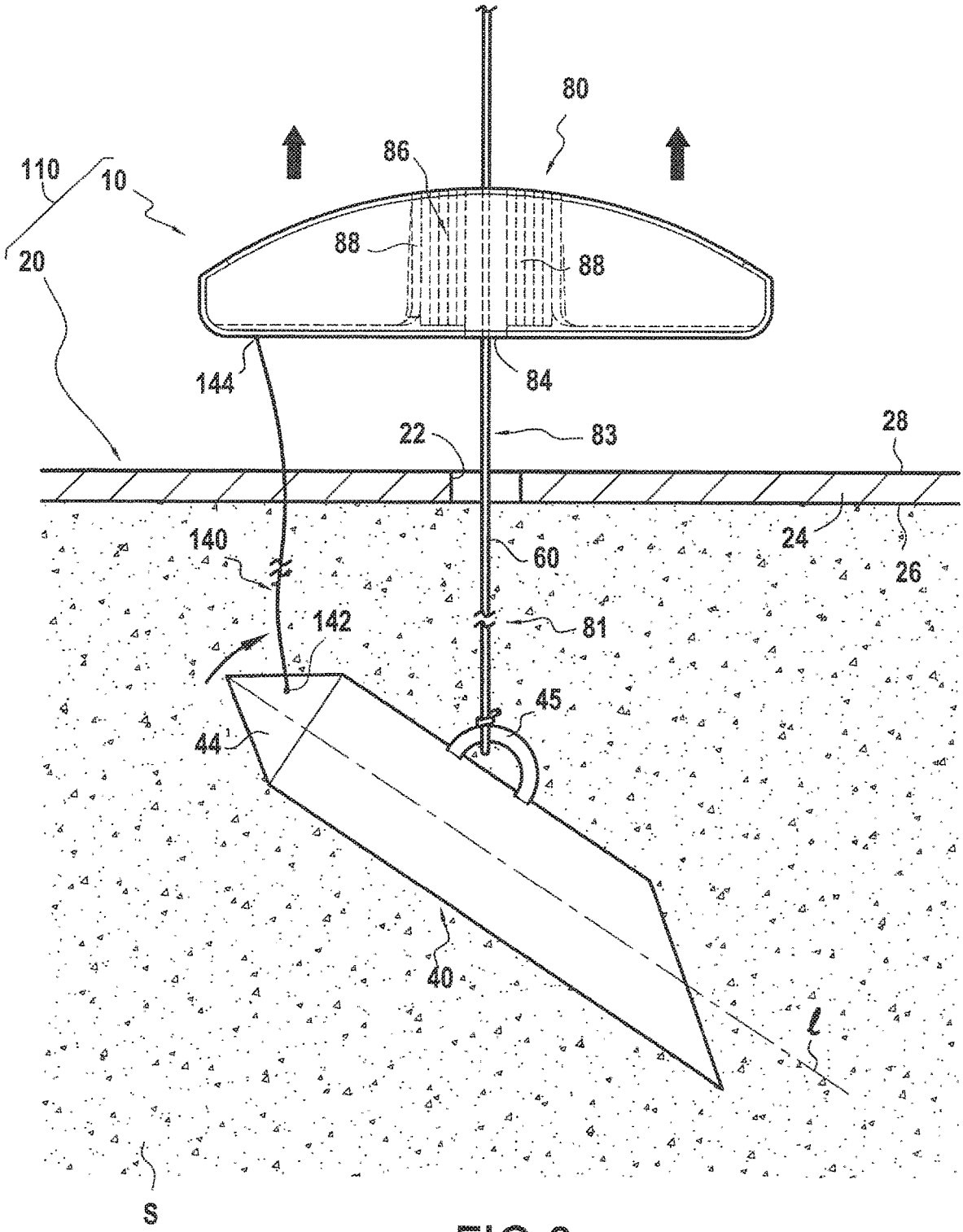
FIG. 6 is a diagram showing the first example of the anchoring assembly of the present invention, the blocking device being in the first position, the anchoring part passing from the anchoring position to the withdrawal position, the blocking device also being used as a traction device.

FIG. 6 shows the anchoring part 40 passing from the anchoring position to a withdrawal position.

To do this, the traction and blocking device 80 is initially placed in the first position, in such a manner as to enable the traction and blocking device 80 to slide along the flexible line 60. By applying traction to the withdrawal means 140, by means of a force applied on the traction and blocking device 80 in a substantially vertical upwards direction, the head 44 of the anchoring part 40, to which the first end 142 of the withdrawal means 140 is fastened, is pivoted upwards. The traction applied by the withdrawal means 140 continues until the longitudinal direction l of the anchoring part 40 is substantially vertical, the anchoring part 40 then being in the withdrawal position.

Figure 7:
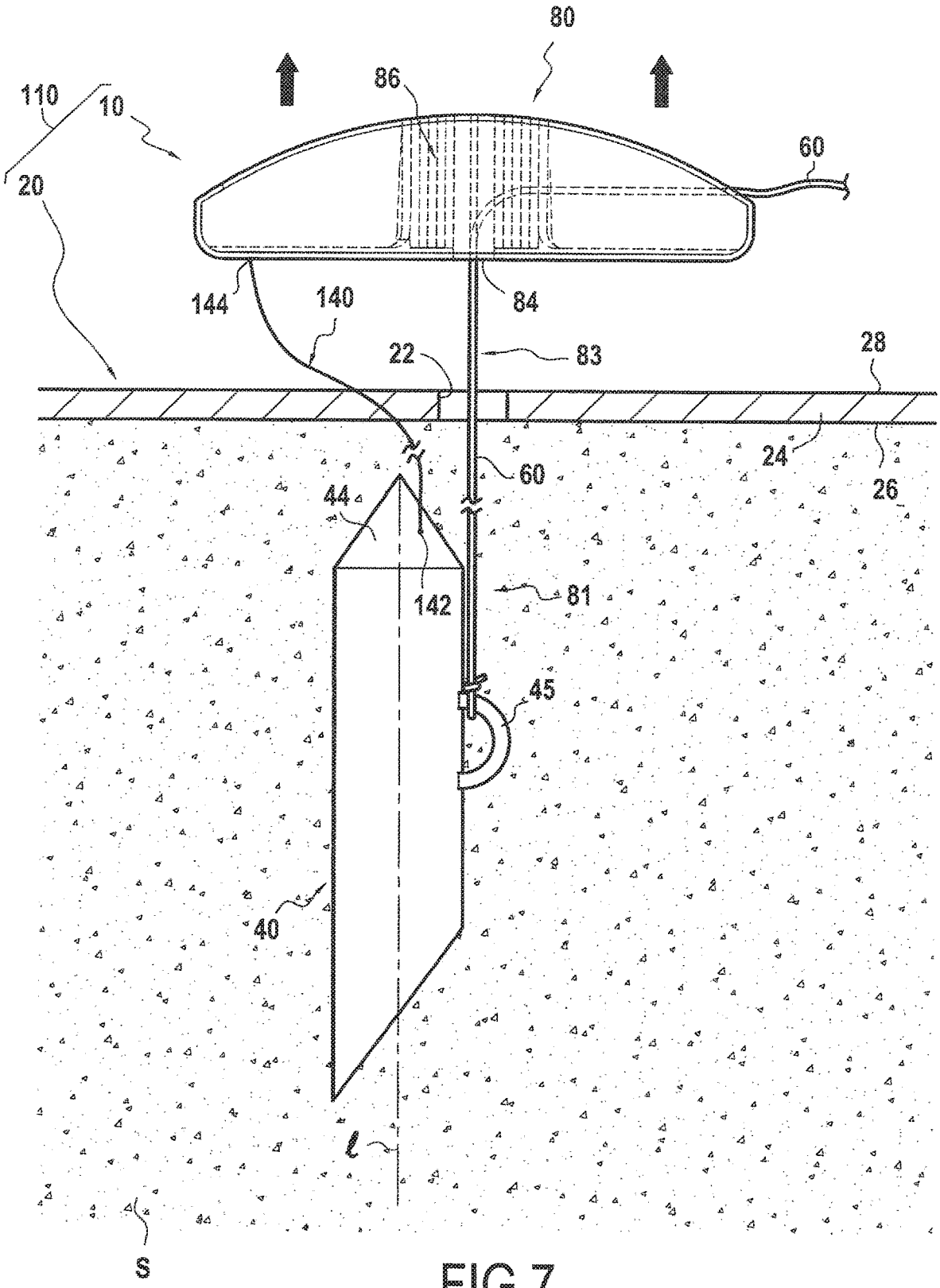
FIG. 7 is a diagram showing the first example of the anchoring assembly of the present invention, the blocking device being in the second position, the anchoring part being in the withdrawal position.

FIG. 7 shows the anchoring assembly 10 in which the anchoring part 10 is in the withdrawal position. The traction and blocking device 80 is then placed in the second position, so as to prevent the traction and blocking device 80 from sliding along the flexible line 60, and, consequently, so as to prevent movement of the traction and blocking device 80 relative to the anchoring part 40. By applying traction to the traction and blocking device 80, in a substantially vertical upwards direction, represented by the two vertical arrows in FIG. 7, the anchoring part 40 can thus be raised to the surface of the ground, the shape of the head 44, that enabled the anchoring part 40, in the anchoring position, to be pushed in the ground S, e.g. its beveled or rounded shape, enables the anchoring part 40 while in the withdrawal position to be withdrawn from the ground S, e.g. in order to be stored or used at another site.

Figure 8A:
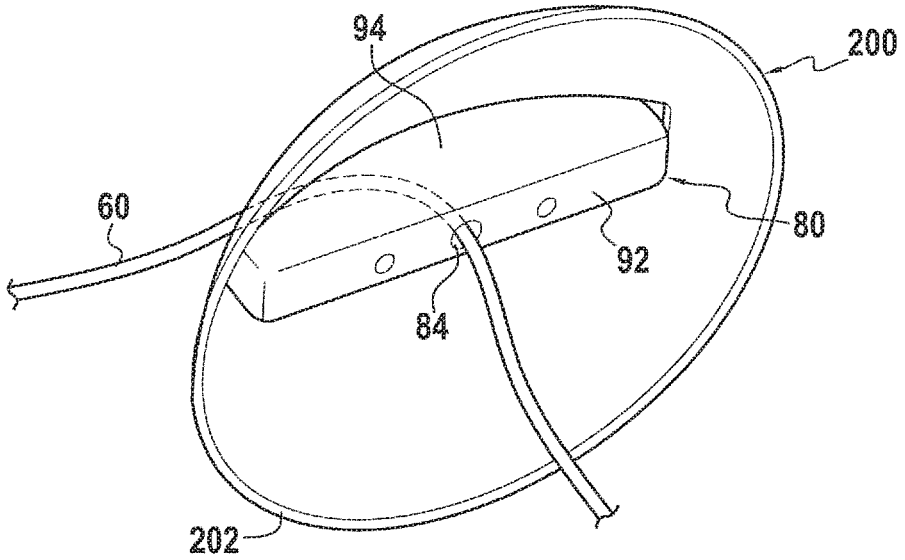
FIGS. 8A and 8B are perspective views of a blocking device and of a run-over device of a second example of an anchoring assembly of the present invention.
Figure 8B:
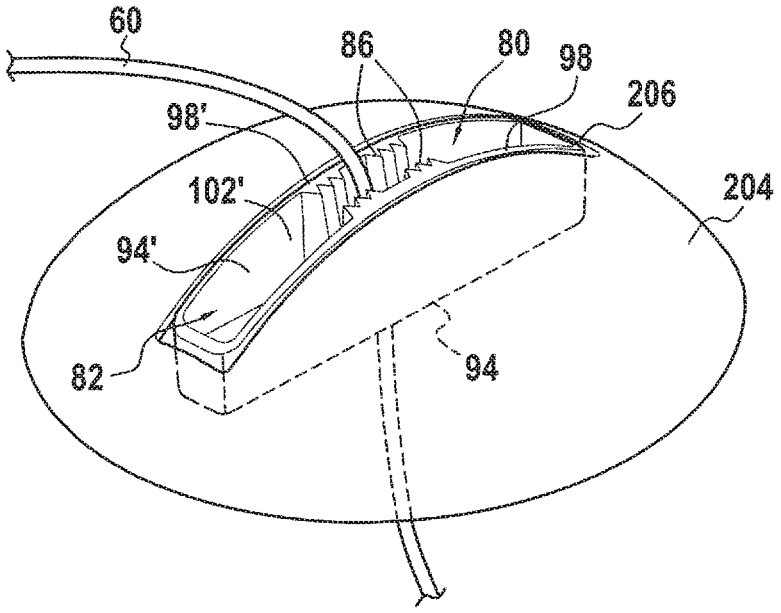

FIGS. 8A and 8B show perspective views of an anchoring part 210 in a second embodiment. In a manner similar to that of the above-described first embodiment, the anchoring assembly 210 comprises a traction and blocking device 80, identical to that described with reference to the figures showing the first embodiment of the anchoring assembly 10, and a run-over device 200, which surrounds the traction and blocking device 80.

As shown, the run-over device 200 has a contact surface 202 and a convex top surface 204 that defines a spherical cap, for example and in non-limiting manner.

The convex top surface 204 includes a slot 206 dimensioned in such a manner as to receive the traction and blocking device 80; more particularly, the dimensions of the slot 206 are equal to, or slightly greater than, the dimensions of the gutter 82, considered in a plane that is transverse to the bottom wall of the gutter 82. It is thus understood that the convex top surface 204 of the run-over device 200 is configured to surround the traction and blocking device 80.

By way of example and in non-limiting manner, the height of the spherical cap defined by the convex surface 204 is substantially equal to the maximum height of the first and second sides 94, 94' that define the gutter 82.

The term "maximum height" of the first and second sides 94, 94' is used to indicate the maximum distance between the bottom margins 96, 96' and the top margins 98, 98' of the first and second sides 94, 94'.

Thus, when the run-over device 200 is arranged on the ground, as shown in FIG. 8B, the base 92 of the gutter 82 is at the same level as the contact surface 202 of the run-over device 200, whereas its top margins 98, 98' come into contact with the convex top surface 204.

The presence of the run-over device 200 does not modify the use of the traction and blocking device 80, nor the sequence of steps of installing the anchoring assembly 210, as described above with reference to FIGS. 2 to 7 showing the first embodiment of the anchoring assembly 10.

In particular, actuation of the traction and blocking device 80, in such a manner as to cause it to pass from one to the other of the first and second positions, may alternatively be performed when the traction and blocking device 80 is housed in the run-over device 200, or prior to engagement of the traction and blocking device 80 in the slot 206 of the run-over device 200.

Figure 9:
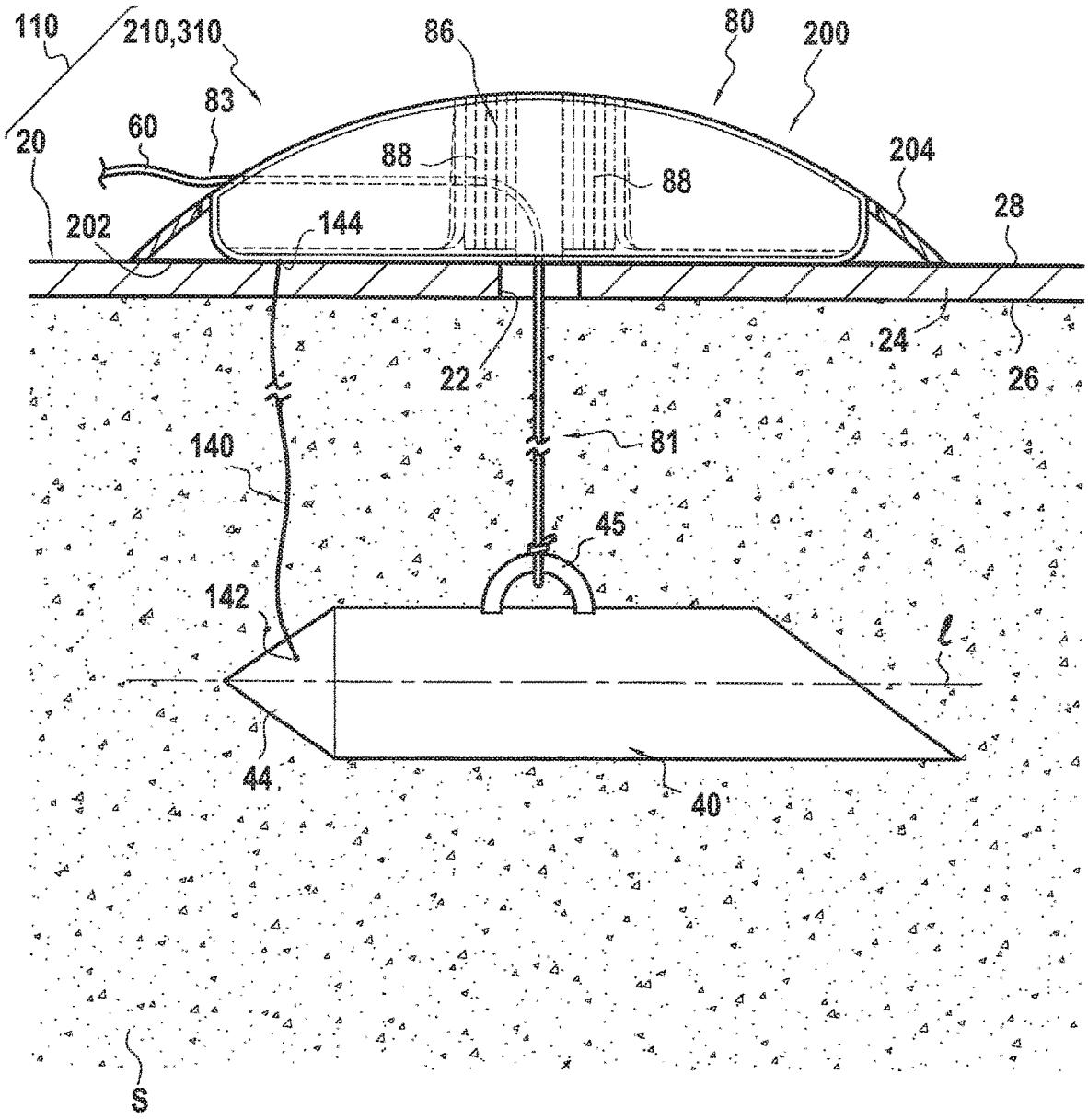
FIG. 9 is a diagram showing the second example of the anchoring assembly of the present invention, the blocking device being in the second position, the anchoring part being in the anchoring position.

FIG. 9 shows the second embodiment of the anchoring assembly 210, the traction and blocking device 80 being in the second position, the anchoring part 40 being in the anchoring position.

In this position, the surface covering 24 is arranged between the ground S and the assembly formed by the run-over device 200 and the traction and blocking device 80;

more particularly, the contact surface 202 of the run-over device 200 and the outside face of the base 92 of the traction and blocking device 80 are arranged against the outside face 28 of the surface covering 24.

The term "outside face" of the base 92 refers to the face of the base 92 that is opposite from the bottom wall of the gutter 82.

The convex top surface 204 of the run-over device 200 is such that vehicle movement means, e.g. a wheel, can pass over the assembly constituted by the run-over device 200 and the traction and blocking device 80 without being damaged. In particular, since the top margins 98, 98' come into contact with the convex surface 204, when the movement means pass over the traction and blocking device 80 they are unlikely to be damaged or punctured by the ribs 88, 88' formed on the first and second inside faces 102, 102' of the first and second sides 94, 94'.

Figure 10A:
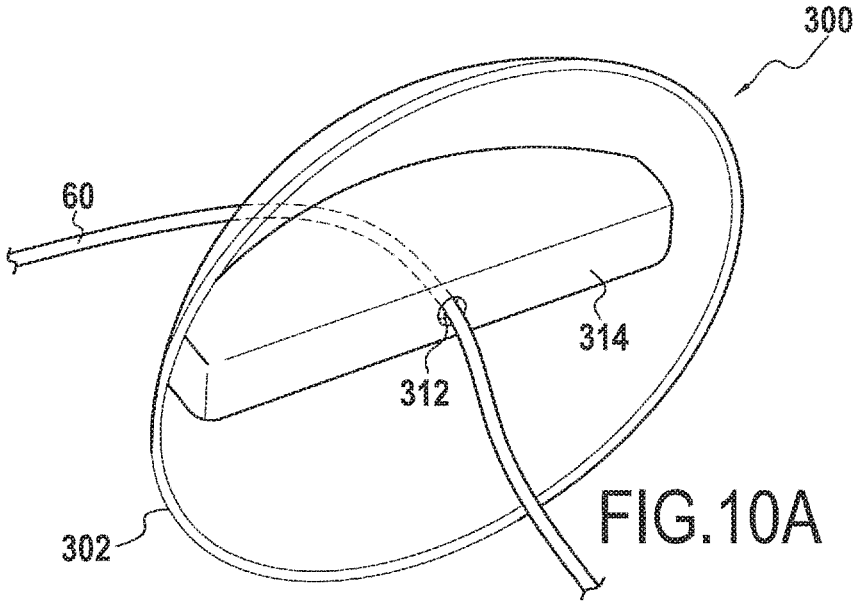
FIGS. 10A and 10B are perspective views of a blocking device and of a run-over device of a third example of an anchoring assembly of the present invention.
Figure 10B:
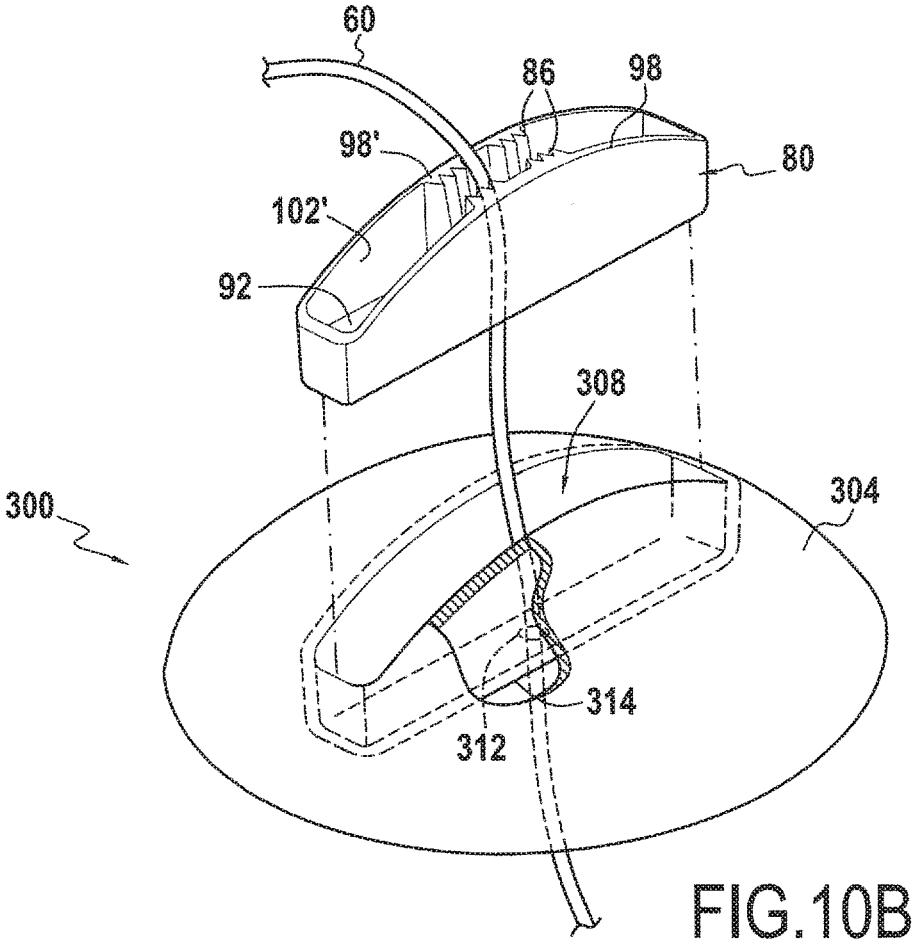

FIGS. 10A and 10B are perspective views of a part of an anchoring assembly 310 in a third embodiment. In manner similar to the above-described second embodiment with reference to FIGS. 8A and 8B, the anchoring assembly 310 comprises a traction and blocking device 80 and a run-over device 300 that surrounds the traction and blocking device 80, by having a contact surface 302, and a convex top surface 304 that defines, for example and in non-limiting manner, a spherical cap.

The run-over device 300 further comprises a housing 308 that opens out to the convex top surface 304; the housing 308 presents a bottom wall 314, in which an opening 312 is formed; the housing 308 is dimensioned in such a manner as to receive the traction and blocking device 80.

For example and in non-limiting manner, the bottom wall 314 is arranged in the same plane as that defined by the contact surface 302 of the run-over device 300, so as to contribute to the stability of installation of the anchoring assembly 310.

In addition, the width of the housing 308 is equal to, or even slightly greater than, the width of the traction and blocking device 80.

The housing 308 of the run-over device 300 is also dimensioned in such a manner that, when the base 92 of the traction and blocking device 80 is arranged on the bottom wall 314 of the housing 308, the top margins 98, 98' come into contact with the convex top surface 304. In addition, the opening 312 in the run-over device 300 is then located facing the opening 84 formed in the traction and blocking device 80.

Thus, as shown in particular in FIG. 10B, the flexible line 60 passes successively through the openings 84 and 312 formed respectively in the base 92 of the traction and blocking device 80, and in the bottom wall 314 of the run-over device 300.

It can thus be understood that, when the traction and blocking device 80 is in the second position and the anchoring part 40 is in the anchoring position, as shown in particular in FIG. 9, the bottom wall 314 of the run-over device 300 of the anchoring assembly 310 in the third embodiment is sandwiched between the base 92 of the traction and blocking device 80 and the top face 26 of the surface covering 24. This arrangement makes it possible, amongst other things, to keep the run-over device 300 in place, in particular so as to avoid it being moved, for example by the wind.

All of the above description is given by way of example and is therefore not limiting on the invention; in particular, although the invention is particularly adapted to fastening a surface covering to the ground, it can also be used to hold any element fastened to the ground.

As described in particular with reference to FIG. 3, the flexible line 60 is engaged in the orifice 22 of the element 20 and in the opening 84 of the traction and blocking device 80 after the anchoring part 40 has been pushed into the ground; naturally, and without going beyond the ambit of the invention, it could be envisaged that the flexible line is engaged in the orifice and in the opening before the anchoring part 40 is pushed into the ground.

In addition, and as can be seen from FIGS. 1A, 1B, and 1C, the traction and blocking device 80 consists of only one part: the ribs 88, 88' being formed directly on the inside faces 102', 102' of the first and second sides 94, 94'; naturally, and without going beyond the ambit of the invention, there could be envisaged a traction and blocking device 80 with blocking means 86 made from a material other than that constituting the traction and blocking device 80, while being fastened, e.g. by welding or by adhesive, on the inside faces of the first and second sides 94, 94'. There could also be envisaged a traction and blocking device comprising a reinforcing plate arranged on the base 92, the reinforcing plate including a notch arranged in register with the opening 84.

In addition, the opening 84 of the traction and blocking device 80 presents a circular shape, for example and in non-limiting manner; naturally, there could be envisaged any other shape of opening formed in the base 92 and configured in such a manner as to enable the flexible line 60 to slide in the traction and blocking device 80.

Furthermore, there could also be envisaged an anchoring assembly 10 having withdrawal means 140 that are not fastened to the traction and blocking device 80, but having a second end 144 that is left free on the surface of the ground S, without going beyond the ambit of the present invention; an anchoring assembly 10 that does not include withdrawal means 140 could just as easily be envisaged, the anchoring part 40 remaining in the ground S, or being withdrawn by any other means.

Finally, in the second and third embodiments of the anchoring assembly 210, 310 described with reference to the FIGS. 8A, 8B, 9, 10A, and 10B, the run-over device and the traction and blocking device constitute two distinct parts, the run-over device being configured to surround the traction and blocking device. There could just as easily be envisaged, and without going beyond the ambit of the present invention, a single part comprising, at least, a gutter on the inside faces of which blocking means would be formed and a domed surface over which a vehicle can pass. In such an alternative embodiment, the first and second sides 94, 94' defining the gutter 82 of the traction and blocking device 80 would be constituted by convex portions of the run-over device 200, 300; more particularly, each of the first and second sides 94, 94' would extend respectively between the first and second inside faces 102, 102', and the peripheral margin of the corresponding contact surface 202, 302.

As described above, and as shown in particular in FIG. 3, passing of the anchoring part 40 from the insertion position to the blocking position is made possible by traction exerted on the traction and blocking device 80 of the present invention. Naturally, and without going beyond the ambit of the present invention, there could be envisaged a blocking device 80 that would enable the various steps of the above-described method of fastening to the ground an element for fastening to the ground to be implemented with the exception of the step enabling the anchoring part 40 to pass from its insertion position to its blocking position, this step being implemented in alternative manner by exerting traction on traction means 70, or by exerting traction directly on the flexible line 60.

Figure 11:
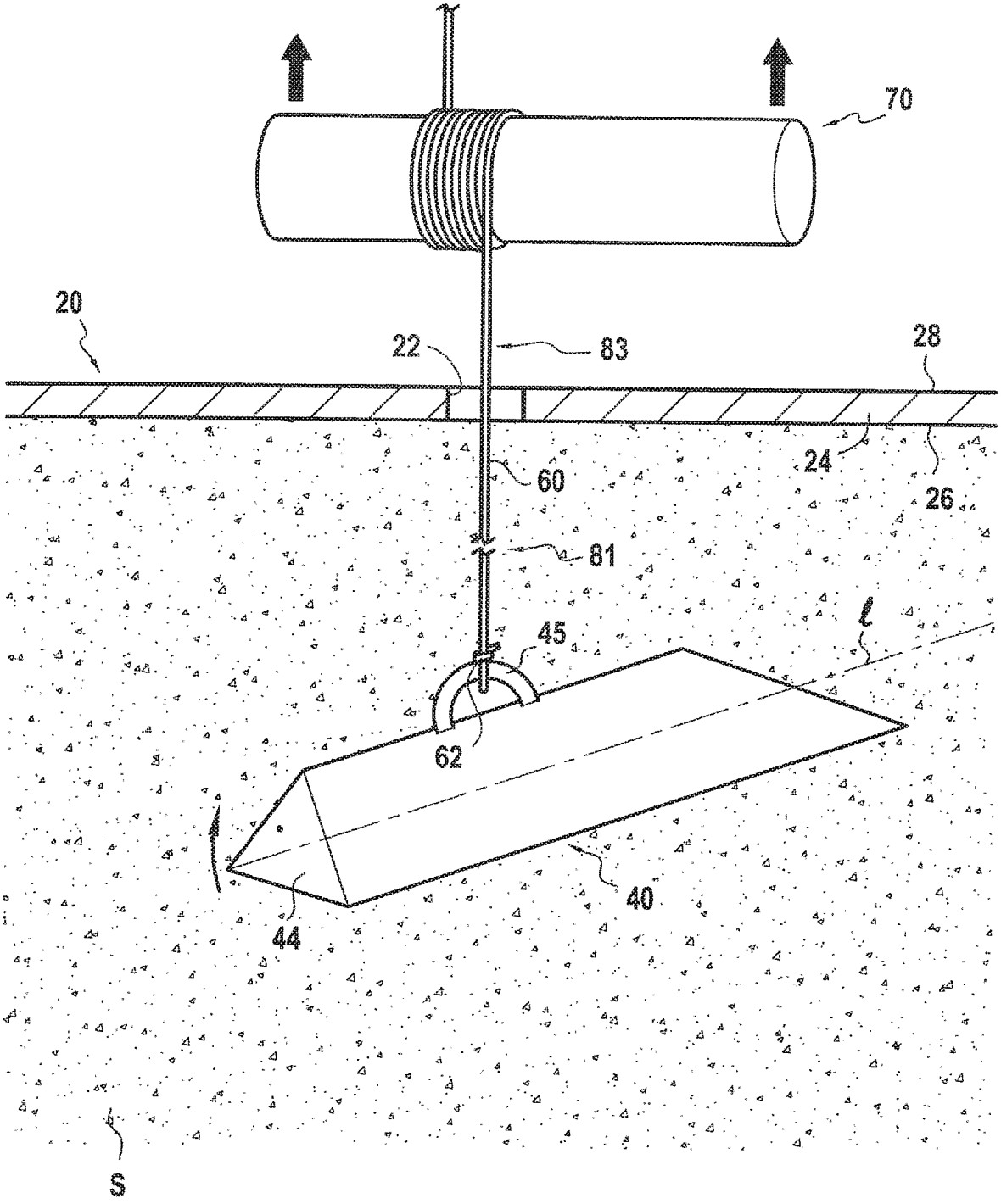
FIG. 11 shows a traction device and an anchoring part passing from the insertion position to the anchoring position.

By way of example and in non-limiting manner, the traction means 70, as shown in FIG. 11, comprise a part of substantially cylindrical shape around which a portion of the flexible line 60 is wound, in order to enable the user to exert traction vertically upwards, by taking hold of the traction means 70.

Thus, in unchanged manner, the steps shown in FIGS. 2, 4, and 5 are implemented by the blocking device 80 of the present invention, the step shown in FIG. 3, and possibly also those shown in FIGS. 6 and 7, being implemented by the traction means 70.

What is claimed is:

1. An anchoring assembly for fastening an element to the ground, the element including an orifice, wherein the anchoring assembly comprises:

an anchoring part;

a flexible line having a first end that is fastened to the anchoring part, the flexible line being designed to pass through the orifice; and a blocking device including a gutter defined by a base and by first and second walls protruding transversally from the base, and an opening formed in the base through which the flexible line extends, the blocking device being configured to prevent sliding of the flexible line in the opening, the blocking device being configured to take a first position in which the flexible line is configured to slide in the opening in such a manner as to adjust the distance between the blocking device and the anchoring part, and a second position in which the flexible line is blocked in the blocking device in such a manner as to prevent the blocking device from moving relative to the anchoring part, wherein, when the blocking device is in the second position, the flexible line has a first portion extending in the gutter substantially in a parallel manner relative to the first and second walls, and a second portion extending outside the gutter and transversally to the base.

2. The anchoring assembly according to claim 1, wherein the blocking device comprises at least one rib extending from each of the first and second walls.

3. The anchoring assembly according to claim 2, wherein the first and second walls respectively present first and second top margins and in that the ribs are arranged facing each other with each presenting a ridge, the distance between the ridges of the ribs near the base being smaller than the distance between the ridges near the first and second top margins.

4. The anchoring assembly according to claim 2, wherein the blocking device comprises a plurality of ribs formed on the first and second walls while being arranged on either side of the opening.

5. The anchoring assembly according to claim 1, wherein the first and second walls respectively present first and second top margins and wherein at least one of the first and second top margins of the blocking device is rounded.

6. The anchoring assembly according to claim 1, wherein the opening is formed in the middle of the base, between the first and second sides.

7. The anchoring assembly according to claim 1, wherein the first and second sides respectively present first and second bottom margins and wherein the blocking device presents at least one rounded section between one of the first and bottom margins and the base.

8. The anchoring assembly according to claim 1, wherein the anchoring assembly further comprises a run-over device configured to be arranged around the blocking device.

9. The anchoring assembly according to claim 8, wherein the run-over device presents a convex top surface surrounding the blocking device.

10. The anchoring assembly according to claim 8, wherein the run-over device includes a housing having a bottom wall arranged to receive the blocking device.

11. The anchoring assembly according to claim 1, wherein the anchoring part presents a longitudinal direction and comprises a body and a head, which anchoring part is suitable for taking up either an insertion position in which the longitudinal direction is substantially vertical, its head forming a bottom end, or an anchoring position in which the longitudinal direction is substantially horizontal, a force applied to the blocking device when it is in the second position serving to cause the anchoring part to pass from the insertion position to the anchoring position.

12. The anchoring assembly according to claim 11, comprising a withdrawal device comprising a first end fastened to the head of the anchoring part, and a second end configured to be at a surface of the ground when the anchoring part is placed in the ground, the withdrawal device being configured such that traction applied to the withdrawal device serves to pass the anchoring part from the anchoring position to a withdrawal position in which the longitudinal direction is substantially vertical, the head forming a top end.

13. The anchoring assembly according to claim 12, wherein the second end of the withdrawal device is fastened to the blocking device.

14. The anchoring assembly according to claim 1, wherein the blocking device is also a traction and blocking device.

15. The anchoring assembly according to claim 1, further comprising a fastener for fastening to the ground, the fastener comprising a surface covering presenting a bottom face, arranged towards the ground, and a top face, opposite the bottom face, wherein the blocking device is arranged against the top face of the surface covering when it is in the second position.

16. The anchored installation according to claim 15, wherein the blocking device is fastened to the top face of the surface covering.

17. A method for fastening a mat on a ground comprising:

providing the mat having an orifice that is placed on the ground;

providing an anchoring assembly comprising:

an anchoring part presenting a longitudinal direction and comprising a body and a head, wherein the anchoring part is suitable for taking up either an insertion position in which the longitudinal direction is substantially vertical, its head forming a bottom end, or an anchoring position in which the longitudinal direction is substantially horizontal;

a flexible line having a first end that is fastened to the anchoring part, the flexible line being designed to pass through the orifice; and a traction and blocking device including a gutter defined by a base and by first and second walls protruding transversally from the base, and an opening formed in the base through which the flexible line extends, the traction and blocking device comprising a plurality of ribs formed on the first and second walls while being arranged on either side of the opening, the traction and blocking device being configured to prevent sliding of the flexible line in the opening, the traction and blocking device being configured to take a first position in which the flexible line is configured to slide in the opening in such a manner as to adjust the distance between the traction and blocking device and the anchoring part, and a second position in which the flexible line is blocked in the traction and blocking device in such a manner as to prevent the traction and blocking device from moving relative to the anchoring part, wherein, when the traction and blocking device is in the second position, the flexible line has a first portion extending in the gutter substantially in a parallel manner relative to the first and second walls, and a second portion extending outside the gutter and transversally to the base, and wherein a force applied to the traction and blocking device when it is in the second position causes the anchoring part to pass from the insertion position to the anchoring position;

engaging the flexible line in the orifice of the mat and in the opening of the traction and blocking device;

arranging the anchoring part in the insertion position;

pushing the anchoring part into the ground;

placing the traction and blocking device in the second position;

pulling on the traction and blocking device to cause the anchoring part to pass from the insertion position to the anchoring position;

placing the traction and blocking device in the first position;

bringing the traction and blocking device against the mat by sliding it along the flexible line; and placing the traction and blocking device in the second position by engaging the flexible line with the ribs, so that the mat is firmly maintained between the ground and the traction and blocking device.

18. An anchoring assembly for fastening an element to the ground, the element including an orifice, wherein the anchoring assembly comprises:

an anchoring part;

a flexible line having a first end that is fastened to the anchoring part, the flexible line being designed to pass through the orifice; and a traction and blocking device including a gutter defined by a base and by first and second slotless walls extending transversally relative to the base, and an opening having material around its entire circumference being formed in the base, the flexible line extending through said opening, the traction and blocking device comprising a plurality of ribs formed on the first and second slotless walls while being arranged on either side of the opening, the traction and blocking device being configured to prevent sliding of the flexible line in the opening, the traction and blocking device being configured to take a first position in which the flexible line is configured to slide in the opening in such a manner as to adjust the distance between the traction and blocking device and the anchoring part, and a second position in which the flexible line engages with the ribs so that the flexible line is blocked in the traction and blocking device in such a manner as to prevent the traction and blocking device from moving relative to the anchoring part.

19. An anchored installation comprising:

a surface covering to be fastened to the ground, the surface covering having a bottom face configured to be directed to the surface of the ground, a top face opposite the bottom face, and an orifice;

an anchoring part to be inserted into the ground;

a flexible line having a first end that is fastened to the anchoring part, the flexible line being designed to pass through the orifice;

a traction and blocking device including a gutter defined by a base and by first and second walls extending transversally relative to the base, and an opening having material around its entire circumference being formed in the base, the flexible line extending through said opening, the traction and blocking device comprising a plurality of ribs formed on the first and second walls while being arranged on either side of the opening, the traction and blocking device being configured to prevent sliding of the flexible line in the opening, the traction and blocking device being configured to take a first position in which the flexible line is configured to slide in the opening in such a manner as to adjust the distance between the blocking device and the anchoring part, and a second position in which the flexible line engages with the ribs so that the flexible line is blocked in the traction and blocking device in such a manner as to prevent the traction and blocking device from moving relative to the anchoring part;

wherein, the surface covering presents a ground secured position in which the flexible line extends through the orifice of the surface covering and the opening of the traction and blocking device, and in which the traction and blocking device is in the second position and in contact with the top face of the surface covering, so that the surface covering is maintained between the ground and traction and the blocking device.

20. An anchored installation according to claim 19, wherein the walls of the traction and blocking device are slotless.

21. An anchoring assembly for fastening an element to the ground, the element including an orifice, wherein the anchoring assembly comprises:

an anchoring part;

a flexible line having a first end that is fastened to the anchoring part, the flexible line being designed to pass through the orifice;

a blocking device including an opening through which the flexible line extends, the blocking device being configured to prevent sliding of the flexible line in the opening, the blocking device being configured to take a first position in which the flexible line is configured to slide in the opening in such a manner as to adjust the distance between the blocking device and the anchoring part, and a second position in which the flexible line is blocked in the blocking device in such a manner as to prevent the blocking device from moving relative to the anchoring part; and a run-over device that presents a convex top surface surrounding the blocking device and defines a spherical cap configured to be arranged around the blocking device.

22. The anchoring assembly of claim 21, further comprising a surface covering configured to be fastened to the ground, wherein the run-over device comprises a contact surface of the surface covering when the surface covering is fastened to the ground.

* * * * *